US005353884A

United States Patent [19]

Misawa et al.

[11] Patent Number: 5,353,884

[45] Date of Patent: Oct. 11, 1994

[54] POSITIONING DEVICE FOR A MEMBER AND DRILLING SYSTEM EMPLOYING SAID POSITIONING DEVICE

[75] Inventors: Toshiaki Misawa; Yoshihide Kiyosawa; Jun Sakata, all of Nagano; Akio Ikeda, Osaka, all of Japan

[73] Assignees: Harmonic Drive Systems, Inc; Sumitomo Metal Industries, Ltd., Osaka, Japan

[21] Appl. No.: 117,204

[22] PCT Filed: Jan. 20, 1993

[86] PCT No.: PCT/JP93/00068

§ 371 Date: Nov. 29, 1993

§ 102(e) Date: Nov. 29, 1993

[87] PCT Pub. No.: WO93/15300

PCT Pub. Date: Aug. 5, 1993

[30] Foreign Application Priority Data

Jan. 23, 1992 [JP] Japan ..... 4-032591

[51] Int. Cl.[5] ..... E21B 7/00

[52] U.S. Cl. ..... 175/26; 175/61; 175/73

[58] Field of Search ..... 175/26, 61, 73–76

[56] References Cited

U.S. PATENT DOCUMENTS

| | | | |
|---|---|---|---|
| 2,745,635 | 5/1956 | Zublin | 255/1.6 |
| 2,891,769 | 6/1959 | Page | 175/76 |
| 2,919,897 | 1/1960 | Sims | 175/76 |
| 3,023,821 | 3/1962 | Etherington | 175/76 X |
| 3,042,125 | 7/1962 | Duncan | 175/76 X |
| 3,043,381 | 7/1962 | McNeely | 175/61 X |
| 3,650,338 | 3/1972 | McNeely | 175/61 X |
| 3,713,599 | 1/1973 | Smith et al. | 74/527 X |
| 4,058,163 | 11/1977 | Yandell | 175/55 X |
| 4,303,135 | 12/1981 | Bonoit | 175/73 |
| 4,346,768 | 8/1982 | Ross | 74/583 X |
| 4,394,881 | 7/1983 | Shirley | 175/76 |
| 4,436,163 | 3/1984 | Simpson | 74/222 X |
| 4,476,943 | 10/1984 | Williams | 175/61 |
| 4,506,590 | 3/1985 | Miki et al. | 192/1.21 X |
| 4,548,282 | 10/1985 | Hurtz et al. | 175/61 |
| 4,632,191 | 12/1986 | McDonald et al. | 175/26 X |
| 4,823,638 | 4/1989 | Ishikawa | 74/640 |
| 4,974,470 | 12/1990 | Ishikawa et al. | 74/640 |
| 5,113,953 | 5/1992 | Noble | 175/61 |
| 5,168,941 | 12/1992 | Krueger et al. | 175/26 |

FOREIGN PATENT DOCUMENTS

| | | |
|---|---|---|
| 3219362 | 4/1983 | Fed. Rep. of Germany . |
| 57-21695 | 2/1982 | Japan . |
| 57-100290 | 6/1982 | Japan . |
| 58-210300 | 12/1983 | Japan . |
| 2091780 | 8/1982 | United Kingdom . |

*Primary Examiner*—Michael Powell Buiz
*Attorney, Agent, or Firm*—Burns, Doane, Swecker & Mathis

[57] ABSTRACT

The present invention relates to a positioning device capable of positioning a member in any direction with a high degree of resolution by using a hollow type harmonic drive mechanism, and to a drilling-direction control device for a drilling system utilizing the positioning device. The device of the present invention is mainly constituted by a double eccentric mechanism section (10). A first annular member (12) is rotatably supported by a circular inner circumferential surface (11*a*) of the cylindrical member (11) of this mechanism section, and a second annular member (13) is rotatably supported by a circular inner circumferential surface (11*b*) of the first annular member. Further, the circular inner circumferential surface (12*b*) of the first annular member formed in a position deviated by a distance "e" relative the center of the cylindrical member, and the circular inner circumferential surface (13*b*) of the second annular member is also formed in a position deviated by the distance "e" relative to the center of the circular inner circumferential surface of the first annular member. It is possible to move the center (C) of the circular inner circumferential surface (13*b*) of the second annular member in any direction within a range of a predetermined radius by relatively rotating these first and second annular members by using hollow type harmonic drive mechanisms (8, 9).

2 Claims, 5 Drawing Sheets

POSITIONING DEVICE FOR A MEMBER AND DRILLING SYSTEM EMPLOYING SAID POSITIONING DEVICE

DESCRIPTION

1. Technical Field

The present invention relates to a positioning device for positioning a member to be driven such as an operational shaft, a probe or the like, and more specifically to a positioning device for positioning a member employing a harmonic drive mechanism of the hollow type.

The present invention also relates to a drilling-direction control device for a drilling system for oil wells or the like, wherein harmonic drive mechanisms are utilized to deflect a rotational drill shaft in a direction approximately perpendicular to its rotational axis, to thereby control the drilling direction of a drill bit mounted on the end of the rotational drill shaft.

2. Background Art

In recent years, such machining process as requiring accurate and fine machining has been increased due to developments of the machine tool technology employing numerical controlling system, IC manufacturing technology and the like. In order to realize a highly accurate machining, the cutting bit or the workpiece have to be precisely brought to a desired position.

On the other hand, in oil well drilling, the drilling direction of a drill bit must be shifted so as to avoid rock beds or the like and continue the drilling operation. Also, in case that the drilling direction of a drill bit falls in a condition deviated from a desired one, it must be controlled so as to adjust the orientation thereof to the desired direction.

In view of the above facts, the purpose of the present invention is to realize a positioning device capable of positioning a member with a high degree of resolution By using a harmonic drive mechanism of the hollow type.

Another purpose of the present invention is to realize a drilling-direction control device for a drilling system such as of an oil well drilling system, which employs harmonic drive mechanisms of the hollow type so that it can be constituted in a compact manner and is capable of controlling a drilling direction with a high degree of resolution.

DISCLOSURE OF INVENTION

In order to achieve the above purposes, a device for positioning a member according to the present invention, comprises a cylindrical member, a first annular member which is rotatably mounted on a circular inner circumferential surface of the cylindrical member and is formed therein with a circular inner circumferential surface deviated from the cylindrical member, a second annular member which is mounted rotatably on said circular inner circumferential surface of the first annular member and is formed therein with a circular inner circumferential surface deviated from the circular inner circumferential surface of the first annular member, and a harmonic drive mechanism for rotating said first and second annular members about their axes with respect to each other. Further, a degree of deviation of the circular inner circumferential surface of the first annular member from the cylindrical member is set equal to that of deviation of the circular inner circumferential surface of the second annular member from the first annular member.

A member to be positioned is connected to the second annular member so that it is moved integrally with the center of the circular inner circumferential surface of the second annular member. In this condition, by rotating the first and second annular members relative to each other, the position of the center of the circular inner circumferential surface of the second annular member can be defined as a sum of vectors representing movements of the centers of the circular inner circumferential surfaces of the respective annular members. Therefore, the first and second annular members are controlled of their rotational angular positions and relative rotation so that the center of the member to be positioned can be positioned at any points within a circle having a radius summed by the amounts of deviation of both circular inner circumferential surfaces.

A drilling-direction control device for a drilling system according to the present invention employs the above-constituted positioning device to partially deflect a rotational drill shaft of the drilling system, to thereby control the drilling direction. More specifically, the drilling direction control device of the present invention has first and second harmonic drive mechanisms of the hollow type arranged coaxially, wherein the first harmonic drive mechanism is connected with a first annular member and the second harmonic drive mechanism is connected with a second annular member.

The second annular member has a circular inner circumferential surface which is formed so as to fixedly receive therein the rotational drill shaft of the drilling system. The rotational drill shaft is arranged so that penetrates through the circular inner circumferential surface of the second annular member and hollow portions of the first and second harmonic drive mechanisms. With this arrangements, by rotating the first and second annular members relative to each other, the center of the circular inner circumferential surface of the second annular member can be moved in any position within a circle having a predetermined radius as mentioned above. In other words, the portion of the rotational drill shaft supported by the circular inner circumferential surface of the second annular member can be deflected by a certain amount in any direction perpendicular to its rotational axis, whereby the drilling direction can be changed.

BEST MOST FOR CARRYING OUT THE INVENTION

Figure 1:
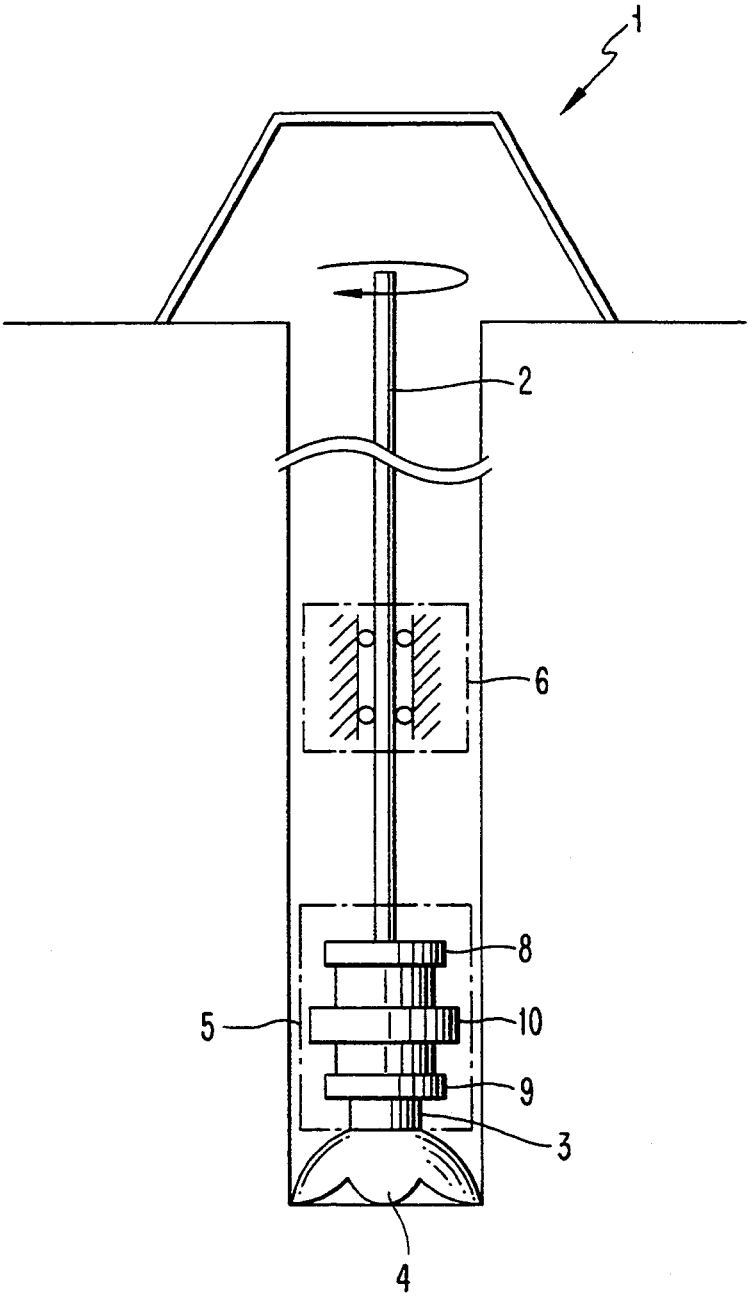
FIG. 1 is a schematic view of an overall structure of an oil well drilling system according to the present invention.

Referring now to the drawings, embodiments of the present invention will be described.

FIRST EMBODIMENT

FIGS. 1 to 5 illustrate an embodiment of the present invention, wherein a drilling-direction control device of an oil well drilling system is constituted according to the present invention.

FIG. 1 illustrates an overall structure of an oil well drilling system of the present embodiment. In this figure, reference numerals 1 and 2 denote an oil well drilling system and a rotational drill shaft thereof, respectively. The rotational drill shaft has a drill collar 3 connected coaxially on the end thereof, and a drilling bit 4 is mounted on the end of the drill collar 3. The rotational drill shaft 2 is connected of its upper side with a drive unit (not shown) for driving thereof. A drilling direction control device 5 is arranged adjacent to an upper side of the drill collar 3 in a manner enclosing the rotational drill shaft 2. A shaft retaining mechanism 6 is provided upper side of the drilling direction control device 5 for maintaining the moving direction of a portion of the rotational drill shaft 2 supported thereby in a predetermined direction, usually in the vertical direction.

Figure 2:
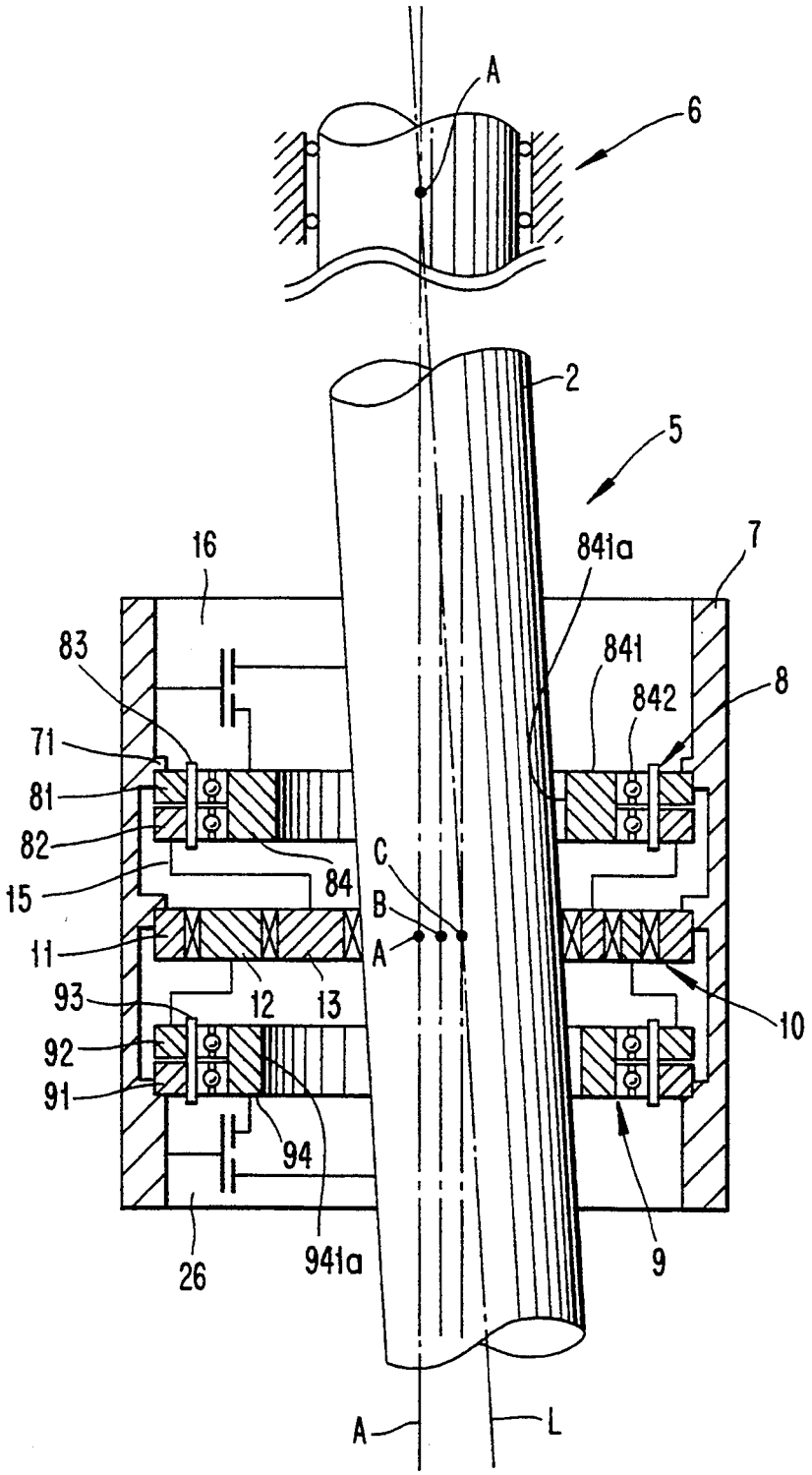
FIG. 2 is a schematic view of a drilling-direction control device provided to the oil well drilling system of FIG. 1.

FIG. 2 shows a schematic section of the drilling direction control device 5 of the present embodiment. The drilling direction control device 5 basically comprises a tubular housing 7 arranged surrounding the rotational drill shaft, hollow type first and second harmonic drive mechanisms 8 and 9 arranged inside of the tubular housing 7 in a manner that they are positioned apart from each other in the vertical direction, and a double eccentric mechanism section 10 positioned between the first and second harmonic drive mechanisms inside the tubular housing 7. The double eccentric mechanism section 10 comprises a cylindrical member 11 fixedly mounted on the inner surface of the housing 7, a first annular member 12 rotatably supported inside the circular member 11, and a second annular member 13 rotatably supported inside the first annular member 12. The housing 7 is formed on its outer circumferential surface with rotation-preventing projections (not shown) which are designed to penetrate into the inner wall of a wellbore to prevent the housing from rotating during drilling operations.

The first harmonic drive mechanism 8 has first and second rigid circular splines 81 and 82, a circular flexible spline 83 arranged inside the rigid circular splines 81 and 82, and an elliptical-shaped wave generator 84 arranged inside the circular flexible spline 83. The wave generator 84 is comprised by an elliptical-shaped rigid cam plate 841 and a ball bearing mechanism 842 inserted between the cam plate and the flexible circular spline 83. The rigid cam plate 841 is formed in its center portion with a hollow portion 841*a*, through which the rotational drill shaft 2 extends loosely. The first rigid circular spline 81 is fixedly mounted on a flange formed integrally on the inner surface of the housing 7. The second rigid circular spline 82 is connected to the second annular member 13 positioned innermost of the double eccentric mechanism section 10 so that the spline 82 and the second annular member 13 rotate integrally. In addition, according to the present embodiment, the wave generator 84 is connected via an electromagnetic clutch mechanism 16 to the rotational drill shaft 2 so that the rotational force from the rotational drill shaft 2 can be transferred to the wave generator 84.

The second harmonic drive mechanism 9 positioned lower side has a similar structure as that of the first harmonic drive mechanism 8. That is, it has first and second circular rigid splines 91 and 92, a circular flexible spline 93 and an elliptical-shaped wave generator 94. The wave generator 94 has a rigid cam plate formed therein with a hollow portion 941*a*, through which the rotational drill shaft 2 extends loosely. The first rigid circular spline 91 is fixedly mounted on the inner surface of the housing 7. The second rigid circular spline 92 is connected to the first annular member 12 positioned midst of the double eccentric mechanism section 10 so as to rotate integrally. The wave generator 94 is connected to the rotational drill shaft 2 via an electromagnetic clutch mechanism 26 so that the rotational force of the shaft 2 can be transferred to the wave generator 94.

Figure 3:
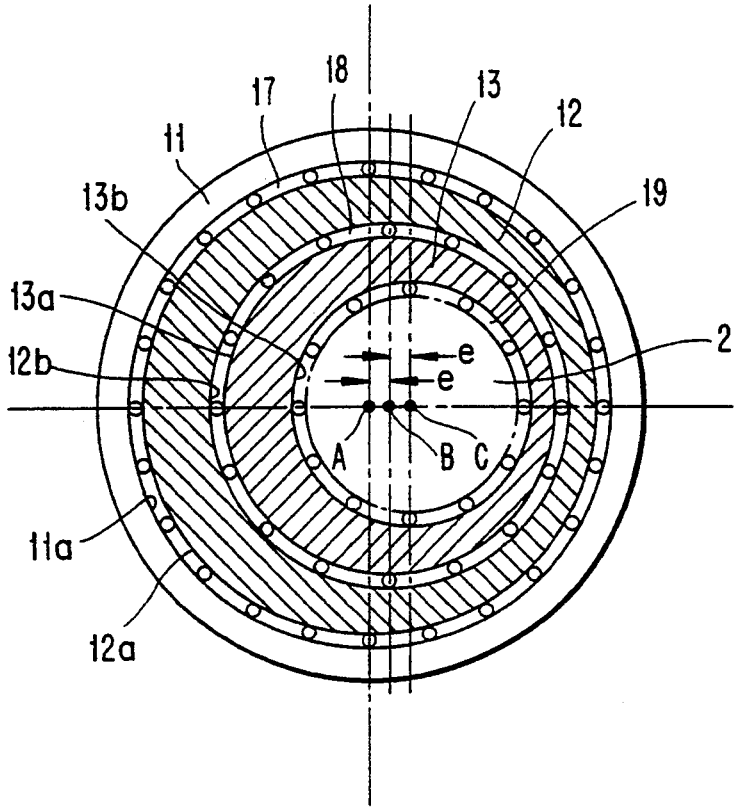
FIG. 3 illustrates a double eccentric mechanism section of the drilling-direction control device of FIG. 2.

Referring also to FIG. 3, the structure of the double eccentric mechanism section 10 will be described. The outermost cylindrical member 11 of this section 10 has a circular inner circumferential surface 11*a* centered on the shaft center defined by the above-mentioned shaft retaining mechanism 6, or the rotational axis A of the shaft 2. The first annular member 12 has a circular outer circumferential surface 12*a* supported rotatably by the circular inner circumferential surface 11*a* via a roller bearing mechanism 17. The first annular member 12 is formed therein with a circular inner circumferential surface 12*a* centered on point B deviated from the rotational axis A of the shaft 2 by a distance "e" The second annular member 13 has a circular outer circumferential surface 13*a* rotatably supported by the circular inner circumferential surface 12*b* via a roller bearing mechanism 18. The second annular member 13 is formed therein with a circular inner circumferential surface 13*b* centered on point C deviated from the center B of the circular inner circumferential surface 12*b* by the same distance "e". This circular inner circumferential surface 13*b* rotatably supports the outer surface of the rotational drill shaft 2 via a roller bearing mechanism 19.

According to the double eccentric mechanism section 10 as constituted above, the center of the circular inner circumferential surface supporting the rotational drill shaft 2 can be moved in any direction within a predetermined distance by controlling the rotational angular positions and relative rotational amount of the first and second annular members 12 and 13.

Figure 4:
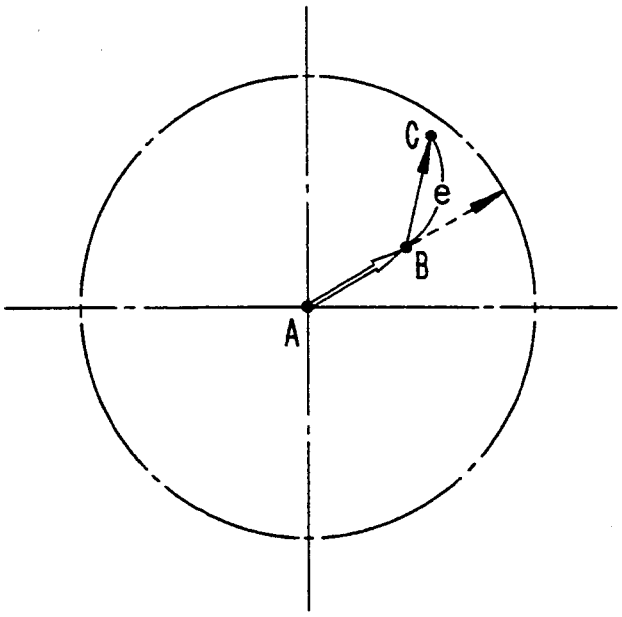
FIG. 4 shows the operation of the drilling-direction control device of FIG. 2.

With reference to FIG. 4, since the circular inner circumferential surface 12*b* of the first annular member 12 has the center B which is deviated from the rotational center A of the shaft 2 by a distance "e", the locus of the center B is represented by a circle having a radius e around the center A. Further, since the circular inner circumferential surface 13*b* of the second annular member 13 has the center C which is deviated from the center B by a distance "e", the locus of the center C is represented by a circle having a radius e around the center B. Hence, the center C can be moved in a desired potion within a circle having a radius of 2*e* around the center A. Therefore, the portion of the rotational drill shaft 2 supported by the double eccentric mechanism section 10 can be deflected in any direction on a plane perpendicular to the rotational axis by a distance up to "2*e*".

Whereas, in the present embodiment, the center of the upper side portion of the rotational drill shaft 2 is supported by the shaft retaining mechanism 6 so that it is maintained on the rotational axis A. Thus, as shown in FIG. 2, the end of the shaft 2 is changed of its moving direction (drilling direction) along a line L passing from the center A of the shaft retaining mechanism 6 to the center C of the double eccentric mechanism section 10.

In the present embodiment, since a degree of deviation of of each of the centers B and C of the circular inner circumferential surfaces formed in the first and second annular members 12 and 13 is set "e", the center C of the portion of the rotational drill shaft 2 extending through the drilling direction control device 5 can be positioned on the rotational axis A of the shaft 2 where the adjustment of toe drilling direction is not required.

Figure 5:
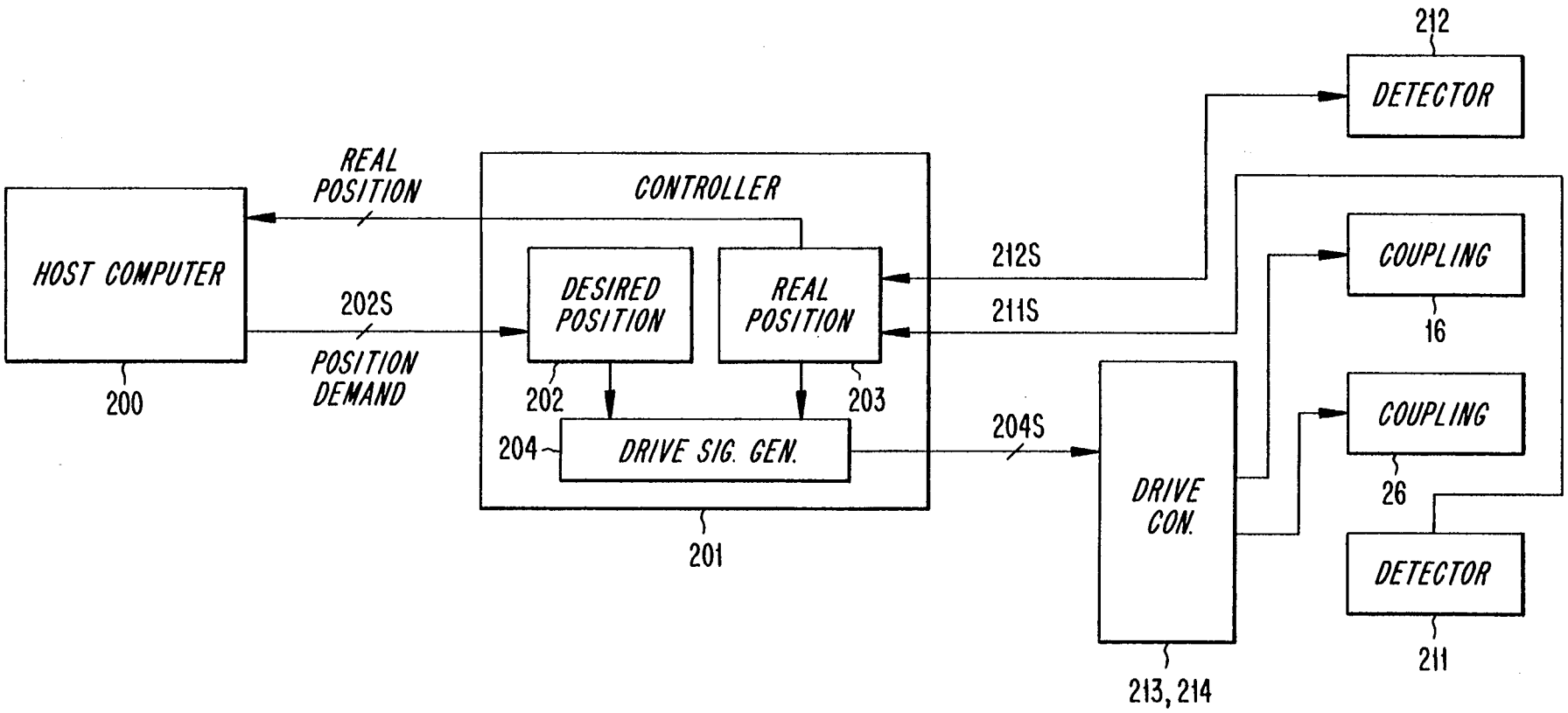
FIG. 5 is a schematic block diagram of the control system for the drilling-direction control system of FIG. 2.

FIG. 5 shows schematically a controlling system of the drilling-direction control device 5 for changing tile drilling direction as mentioned above. In this figure, reference numeral 200 denotes a host computer unit for overall control of the oil well drilling system 1, and reference numeral 201 is a controller for the drilling-direction control device 5. The host computer unit 200 outputs a control signal 202S representing the orientation and angle of the drilling direction, which is supplied to the controller 201. The controller 201 has a desired-rotational-position calculating circuit 202 for calculating desired rotational positions of the respective annular members 12 and 13 in accordance with the received control signal 202S. The controller 201 also has a real-rotational-position detecting circuit 203 for detecting the real rotational positions of the respective annular members 12 and 13, based on detected signals 211S and 212S from detection units 211 and 212 which are mounted on the annular members 12 and 13. Further, the controller 201 has a drive signal generating circuit 204 which generates drive signals 204S for controllably driving tile harmonic drive mechanisms 8 and 9 so that the real rotational positions of the annular members 12 and 13 are brought to desired rotational positions, respectively. The drive signals 204S are supplied to drive control units 213 and 214 for the harmonic drive mechanisms. On receiving the drive signals 204S, the respective drive control units 213 and 214 control the electromagnetic couplings 16 and 26 to drive tile harmonic drive mechanisms 8 and 9, whereby the rigid circular splines 82 and 92, which are output elements of the harmonic drive mechanisms, are rotated to the desired rotational positions and fixed thereto. The above-mentioned operation can be carried out in accordance with control programs prestored in the host computer 200.

As mentioned above, according to the drilling-direction control device of the present embodiment, a pair of harmonic drive mechanisms of the hollow type are employed to change the rotational angular positions and relative rotation of the first and second annular members 12 and 13, whereby the portion of the rotational drill shaft extending through the circular inner circumferential surface of the second annular member is deflected in any direction on a plane perpendicular to the rotational axis by a predetermined distance. Therefore, drilling direction can be changed in any desired direction. In addition, since the harmonic drive mechanisms utilized for the present embodiment are those of high resolution and responsibility, it is capable of performing drilling direction control with excellent controllability. Furthermore, since the harmonic drive mechanisms utilized for the present embodiment are of the hollow type, the drilling-direction control device can be assembled around the rotational drill shaft compactly, and therefore it is advantageous that the mounting space for the device is small.

Second Embodiment

Figure 6:
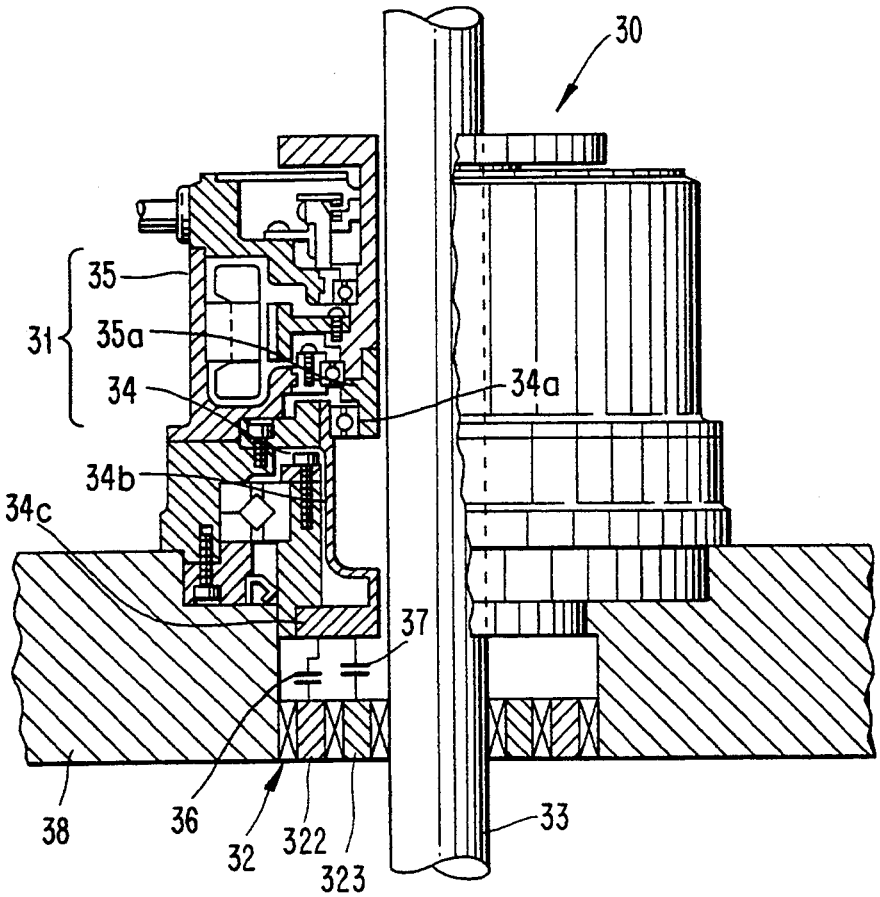
FIG. 6 is a schematic view of a positioning device according to the present invention; and, FIG. 7 illustrates a double eccentric mechanism section of the positioning device of FIG. 6.
Figure 7:
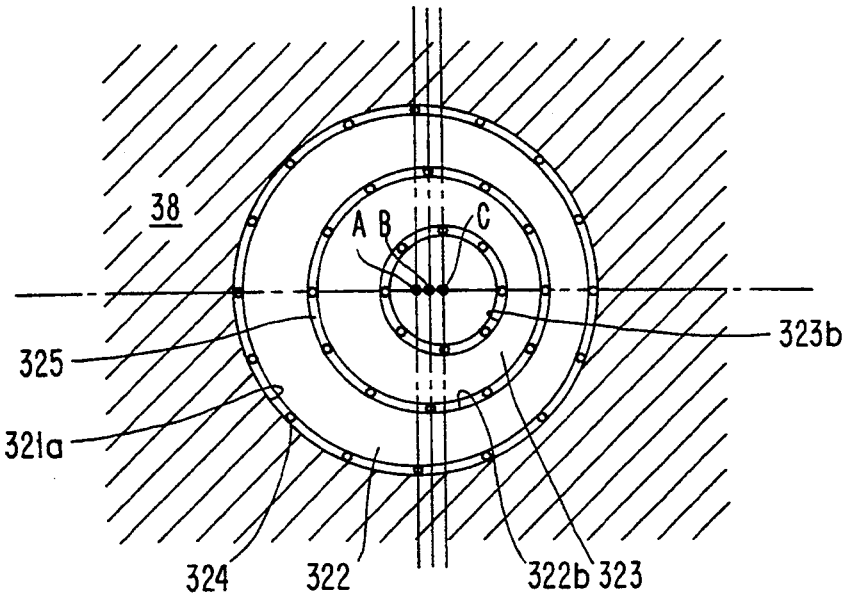

FIGS. 6 and 7 shows a positioning device for a column shaft according to the present invention. The positioning device 30 of the present embodiment has a hollow type actuator 31, an output side of which is connected to a double eccentric mechanism section 32 of the same structure as that of the first embodiment. The column shaft 33 extends through the actuator 31 and the double eccentric mechanism section 32. The actuator 31 is comprised of a cup-shaped harmonic drive mechanism 34 of the hollow type and a hollow type AC servomotor 35 coaxially connected to the harmonic drive mechanism 34. The AC servomotor 35 has a hollow output shaft **35*a* connected to a wave generator 34*a* of the harmonic drive mechanism 34. The lower-speed output element, that is, the cup-shaped flexible spline 34*b* has a flange 34*c* defining the bottom portion thereof, to which first and second annular members 322 and 323 of the double eccentric mechanism section 32 are connected via first and second electromagnetic couplings 36 and 37**, respectively.

In the present embodiment, an outermost cylindrical member of the double eccentric mechanism section 32 (corresponding to the cylindrical member 11 of the first embodiment) is formed integrally on the inner surface of a housing 38 of the positioning device. Thus, the first annular member 322 is rotatably supported on a circular inner circumferential surface **321*a* of the housing 7 via a roller bearing mechanism 324. The first annular member 322 has a circular inner circumferential surface 322*b*, whose center B is located on a position deviated from the center A of the circular inner circumferential surface 321*a*** by a distance "e".

The second annular member 323 is rotatably supported by the first circular inner circumferential surface **322*b* via a roller bearing mechanism 325. The second annular member 323 has a circular inner circumferential surface 323*b*, whose center C is deviated from the center B of the circular inner circumferential surface 322*b*** by the same distance "e".

According to the present embodiment, similar to the first embodiment, the first and second electromagnetic couplings 36 and 37 are controlled of their connecting and disconnecting states to adjust the rotational angular positions and relative rotation of the first and second annular members 322 and 323, whereby it is possible to position the circular inner circumferential surface **323*b* of the second annular member, that is, the center 33*a*** thereof, in any direction within a range of radius 2*e* around the center A.

INDUSTRIAL APPLICABILITY

As explained above, the positioning device of the present invention has the following structure: The first annular member is rotatably supported by the circular inner circumferential surface of the circular member, and the second annular member is rotatably supported by the circular inner circumferential surface of the first annular member. Further, the circular inner circumferential surface of the first annular member is positioned deviated from the center of the circular member, and the circular inner circumferential surface of the second annular member is also positioned deviated from the center of the circular inner circumferential surface of the first annular member. Furthermore, the hollow type harmonic drive mechanism is employed to rotate the first and second annular members with respect to each other. Therefore, a member to be positioned is supported by the circular inner circumferential surface of the second annular member, and the first and second annular members are controllably rotated, whereby the member to be positioned can be located in any direction within a range of a predetermined radius. In addition, since the harmonic drive mechanism employed is of high accuracy and responsibility, positioning of the member can be carried out with excellent controllability and high resolution. Further, since the hollow structure is employed so as to arrange the member to be positioned in the hollow portion, it is advantageous that the mounting space for the device is small and that the device can be constituted in a compact manner.

On the other hand, the drilling-direction control device of the present invention employs the above-mentioned positioning device to deflect the rotational drill shaft of the drilling system. Therefore, the rotational shaft can be precisely deflected in any direction perpendicular to the rotational axis thereof. In addition, it is advantageous that the device can be constituted compactly.

We claim:

1. A positioning device for a member characterized in that it comprises a cylindrical member, a first annular member which is rotatably supported by a circular inner circumferential surface of said cylindrical member and has a circular inner circumferential surface formed in a position deviated from said circular member, a second annular member which is rotatably supported by said circular inner circumferential surface of said first annular member and has a circular inner circumferential surface formed in a position deviated from said circular inner circumferential surface of said first annular member, and a hollow type harmonic drive mechanism for rotating said first and second annular member about their axes relative to each other, wherein a degree of deviation of said circular inner circumferential surface of said first annular member from said cylindrical member is set equal to that of deviation of said circular inner circumferential surface of said second annular member from said first annular member, and wherein a member to be positioned is connected to said second annular member so that it moves integrally with a center of said circular inner circumferential surface of said annular member, whereby said first and second annular members are rotated relative to each other, to thereby carry out a positioning of said member to be positioned.

2. A drilling-direction control device for a drilling system according to claim 1, wherein said harmonic drive mechanism includes first and second harmonic drive mechanisms of the hollow type arranged coaxially, said first harmonic drive mechanism is connected with said first annular member, and said second harmonic drive mechanism is connected with said second annular member, and wherein a rotational drill shaft of said drilling system as said member to be positioned is arranged so that an outer surface thereof is supported by said circular inner circumferential surface of said second annular member, whereby said first and second annular member are rotated relative to each other to move said circular inner circumferential surface of said second annular member eccentrically, to thereby deflect a portion of rotational drill shaft supported by said circular inner circumferential surface in a predetermined direction.

* * * * *